US007393017B2

(12) United States Patent
Carmichael et al.

(10) Patent No.: US 7,393,017 B2
(45) Date of Patent: Jul. 1, 2008

(54) POCKET-SIZED TRAVEL BOOK

(76) Inventors: Andrea Carmichael, 2726 1/2 Cahaba Rd., Mountain Brook, AL (US) 35223; Bobby Frese, 103 Richmar Dr., Birmingham, AL (US) 35213

( * ) Notice: Subject to any disclaimer, the term of this patent is extended or adjusted under 35 U.S.C. 154(b) by 394 days.

(21) Appl. No.: 10/858,703

(22) Filed: Jun. 2, 2004

(65) Prior Publication Data

US 2006/0131867 A1 Jun. 22, 2006

(51) Int. Cl.
*B42D 5/00* (2006.01)

(52) U.S. Cl. ..... 281/15.1; 281/45; 283/38; 283/40; 283/42; 404/57; 404/73; D19/27

(58) Field of Classification Search ..... 281/15.1, 281/21.1, 45; 283/36, 37, 38, 40, 42; 402/57, 402/73; D19/26, 27
See application file for complete search history.

(56) References Cited

U.S. PATENT DOCUMENTS

| | | | | |
|---|---|---|---|---|
| 2,075,529 | A | 3/1937 | Leubrie | |
| 2,336,856 | A | 12/1943 | Freundlich | |
| 2,602,251 | A | 7/1952 | Friedman | |
| 3,526,415 | A | 9/1970 | Freundlich | |
| 3,858,909 | A | 1/1975 | Firedman | |
| 3,877,729 | A | 4/1975 | Friedman | |
| 4,043,573 | A | 8/1977 | Griffin | |
| 4,162,800 | A * | 7/1979 | Gonot et al. | 281/42 |
| 4,840,406 | A | 6/1989 | Pitts | |
| 4,907,905 | A | 3/1990 | Fournier | |
| 5,000,327 | A | 3/1991 | Kincheloe | |
| 5,048,869 | A | 9/1991 | Schwartz | |
| 5,106,097 | A * | 4/1992 | Levine | 273/237 |
| 5,599,044 | A | 2/1997 | Lykens | |
| 5,704,724 | A * | 1/1998 | Karlis et al. | 402/79 |
| 5,823,572 | A * | 10/1998 | NakaMats | 281/2 |
| 5,968,638 | A | 10/1999 | Brown et al. | |
| 6,210,065 | B1 | 4/2001 | Tower | |
| 6,361,075 | B1 | 3/2002 | Ritter et al. | |
| 6,390,713 | B1 * | 5/2002 | Moor et al. | 402/57 |
| 6,612,771 | B1 | 9/2003 | Su | |
| 6,932,534 | B2 * | 8/2005 | O'Hara | 402/73 |
| 2002/0081143 | A1 | 6/2002 | Whang | |
| 2002/0094226 | A1 * | 7/2002 | Sapienza et al. | 402/79 |
| 2003/0184080 | A1 | 10/2003 | Perry | |
| 2004/0136774 | A1 * | 7/2004 | O'Boyle | 402/73 |
| 2006/0150457 | A1 * | 7/2006 | O'Boyle | 40/658 |

* cited by examiner

*Primary Examiner*—Monica S. Carter
*Assistant Examiner*—Michael W Talbot
(74) *Attorney, Agent, or Firm*—Kenneth M. Bush; Bush Intellectual Property Law

(57) ABSTRACT

An improved pocket-sized book capable of one-handed manipulation. The book has informational pages among which a user may navigate by using only the hand holding the book. The book has finger slots for receiving the fingers of a user and a thumb restraint for securing the thumb and thumb mass to prevent both from interfering with either the turning of the pages or the user's view of the information printed thereon. By placing his or her finger on one of the tabs and providing an upward rotational force on the book, a user is able to open the book to the desired section and view the information printed on the pages therein. A guard attached to the side of the book blocks the lateral movement of the pages so that the pages do not become askew.

8 Claims, 2 Drawing Sheets

POCKET-SIZED TRAVEL BOOK

FIELD OF THE INVENTION

The field of the invention relates to a handheld pocket-sized book. In greater particularity, the field of the invention relates to a handheld pocket-sized travel book designed for one-handed manipulation.

BACKGROUND OF THE INVENTION

Pocket-sized travel books are well known in the art. A typical pocket-sized book has front and back covers, pages therebetween for the displaying and/or recording of information, and tabs to indicate different sections of the book. One advantage of the small sizes of these books is that they may generally be held in one hand so that a user's other hand is unencumbered to allow the user to obtain information while simultaneously performing some other activity, such as talking on the phone. However, the structure of prior art pocket-sized books does not allow for easy one-handed manipulation. What is needed is a pocket-sized book that allows easy one-handed manipulation and review of the contents therein.

SUMMARY OF THE INVENTION

In view of the foregoing disadvantages inherent in pocket-sized books known in the prior art, the present invention provides an improved apparatus wherein the same may be manipulated with one hand and information easily obtained therefrom.

To attain this, the preferred embodiment of the present invention is a pocket-sized travel book which preferably comprises a front cover; a back cover having first and second lateral sides; a plurality of content pages between the front and back covers having first and second lateral sides; a tab formed along the second lateral side of each content page to designate the different sections of the book; a plurality of rings engaging the front cover, content pages, and back cover to allow each to be rotated; a plurality of finger slots formed along the second lateral side of the back cover, each of which is designed to receive a finger of the user; a thumb restraint formed along the first lateral side of the back cover; and an elastic band attached to the back cover capable of securing the book.

BRIEF DESCRIPTION OF THE DRAWINGS

The invention will be better understood when consideration is given to the following detailed description thereof. Such description makes reference to the annexed drawings wherein.

DETAILED DESCRIPTION OF THE PREFERRED EMBODIMENT

Figure 1:
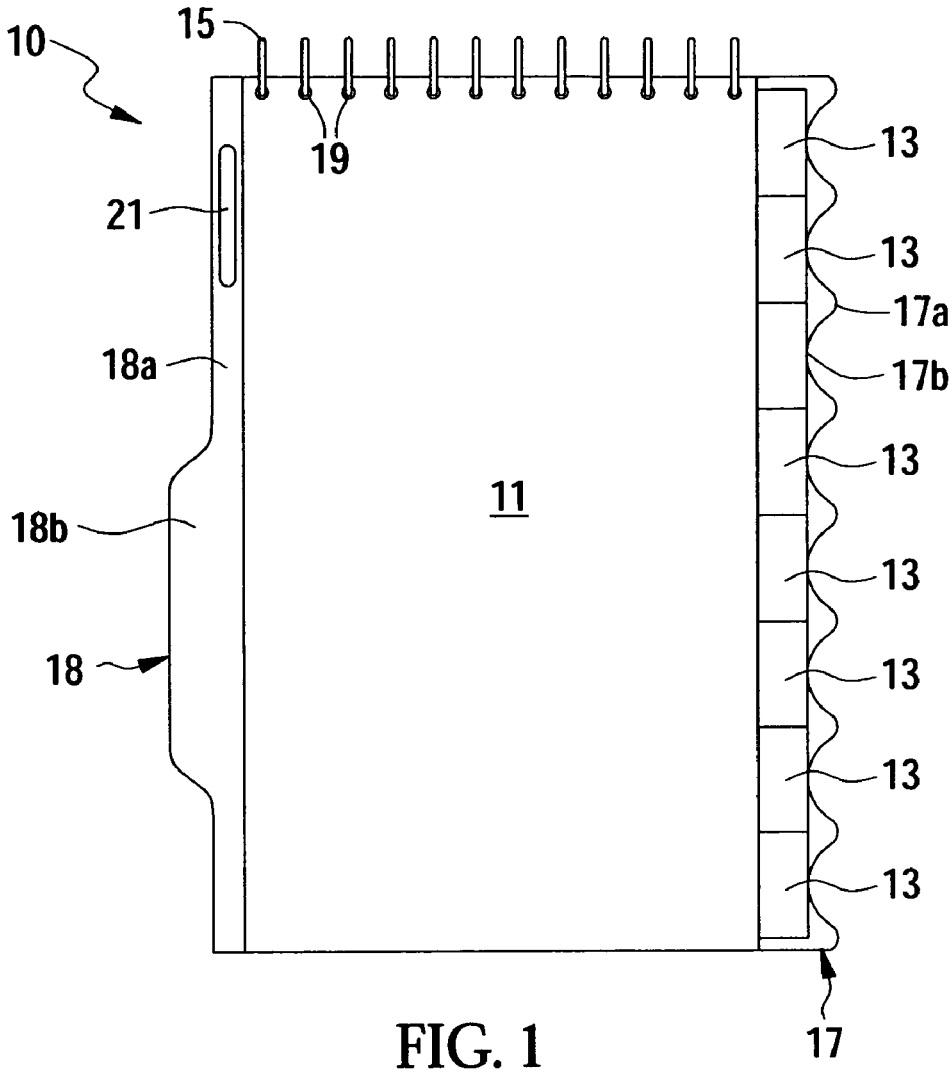
FIG. 1 is a front elevational view of the preferred embodiment of the present invention.

The pocket-sized travel book is indicated generally by the numeral 10. The book 10 has a front cover 11, which preferably indicates the substance of the information contained in the book 10, such as the city for which travel information is being provided. Behind the front cover 11 is a plurality of pages 12 upon which the travel information is printed. Behind the last page is a back cover 14. The front cover 11, pages 12, and back cover 14 are all sized to allow the book 10 to be easily held in one hand of the user. For example, the front cover 11, pages 12, and back cover 14 are preferably each rectangular and measure approximately 3 inches wide by approximately 5.5 inches high to allow such one-handed control.

Figure 2:
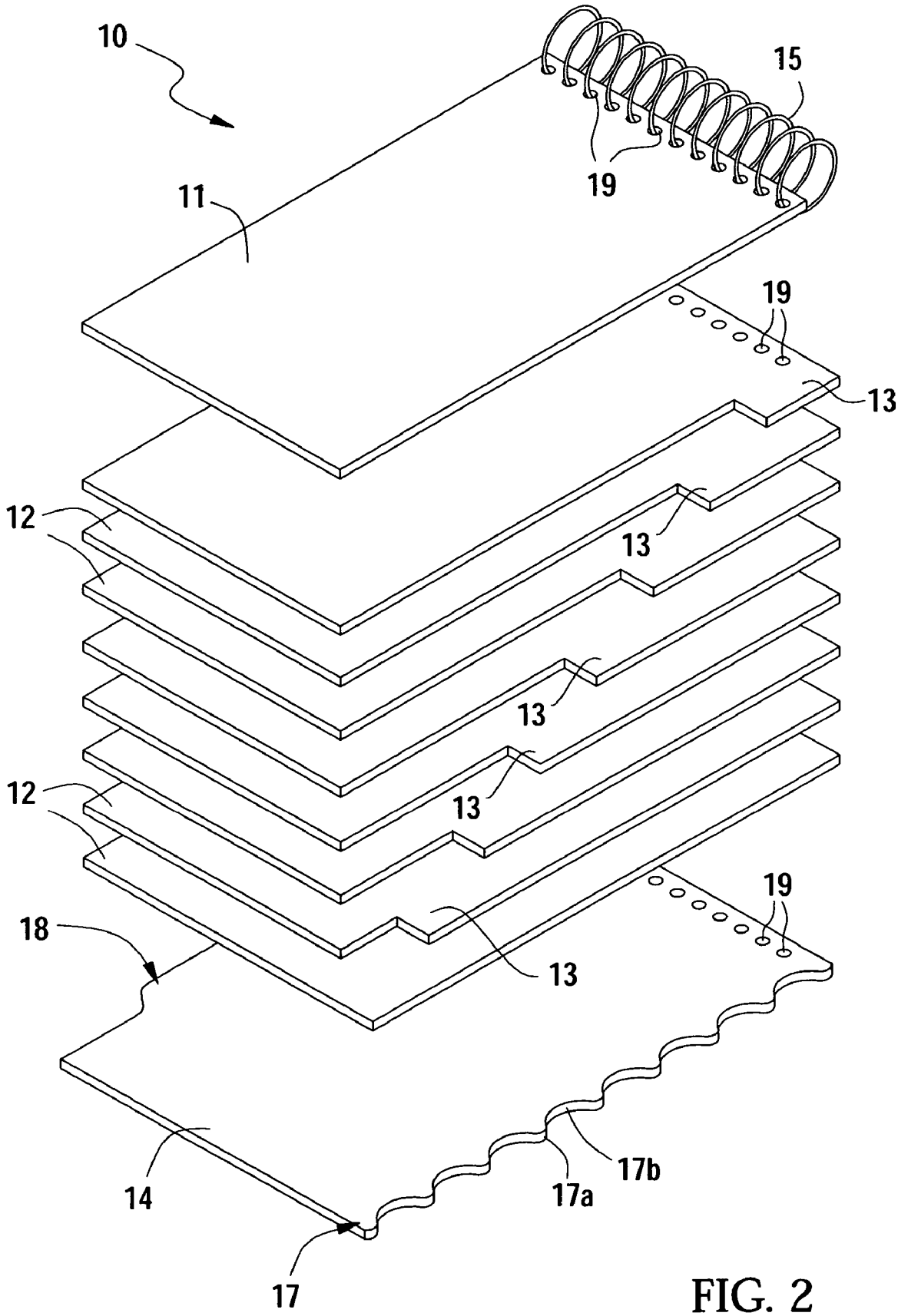
FIG. 2 is an exploded perspective view of the preferred embodiment of the present invention.

The book 10 has a plurality of tabs 13, each of which is formed along the second lateral side of a different page 12. Each of the tabs 13 corresponds to a different section of the book 10. For example, one tab and thus one section might correspond to restaurants located in the city featured in the book 10. In this instance, some designation that the tab corresponds to restaurants would preferably be indicated on the tab, such as the printing of the word "restaurants" or some abbreviation thereof. Preferably, each page 12 has a tab 13 and also has information printed thereon. However, other embodiments are envisioned, such as where each section of the book 10 includes a tab 13 formed along the first page of that section, with the remaining pages corresponding to that section located therebehind. As shown in FIGS. 1-2, the tabs 13 steadily increase in height from the front end to the back end of the book 10 so that a portion of each tab 13 is preferably visible from a front view of the book 10 so that a user may easily select the section of the book 10 that he or she wishes to consult. To allow the tabs 13 to be easily viewed, the second lateral side of the front cover 11 is preferably trimmed by a distance at least as great as the width of the tabs 13, which is preferably approximately 0.375-0.5 inches or some other dimension adequate to allow a user to easily secure a tab 13 with his or her finger. It can be appreciated that the height of each tab 13 not covered by any of the tabs thereabove will preferably depend upon the total number of tabs 13, so that if 5.25 inches of the height of the book 10 is reserved for tabs 13 and the book 10 has 10 tabs, preferably 0.525 inches of the height of each tab 13 will be visible. Preferably, the height of each tab 13 visible from a front view of the book 10 will not measure less than approximately 0.5 inches.

The front cover 11, pages 12, and back cover 14 are all preferably engaged by a plurality of rings 15. To allow this engagement, at the tops of the front cover 11, back cover 14, and every page 12 is a plurality of circular holes 19 through each of which preferably passes a ring 15. Each hole in the front cover 11 is aligned with a hole in each page 12 as well as a hole in the back cover 14, thus allowing each ring 15 to engage the front cover 11, pages 12, and back cover 14 by passing through a hole formed in each of the front cover 11, pages 12, and back cover 14. Each ring 15 is preferably small in relation to the size of the front cover 11, preferably measuring less than approximately 1 inch in diameter, and is preferably made of metal or plastic. The holes 19 preferably have a uniform diameter adequate for allowing the front cover 11, pages 12, and back cover 14 to rotate freely about the rings 15 so that any page may be positioned at the forward end of the book 10 to allow the user to view the contents printed thereon. While the preferred embodiment has a plurality of rings 15, an alternate embodiment would have a coil (not pictured), preferably made of metal, passing through each hole 19 in a manner similar to a typical spiral bound notebook.

Formed along the second lateral side of the back cover 14 is a plurality of finger slots 17. The finger slots 17 are a series of alternating crests 17*a* and troughs 17*b*. Each trough 17*b* is shaped to accommodate a finger of the user. As best shown in FIG. 1, the outside edge of each tab 13 is preferably tangent to the nadir of exactly one trough 17*b*. Measured in a direction parallel to the bottom edge of the book 10, the apex of each crest 17*a* is preferably approximately 0.125 inches beyond this point of tangency. The apex of each crest 17*a* is preferably aligned with the boundary between two tabs such that there is a one-to-one ratio between troughs 17*b* and tabs 13 and a finger in a trough 17*b* is intended to secure exactly one tab 13. The distance between the apices of consecutive crests 17*a* is substantially aligned with the portion of a corresponding tab 13 not covered by any of the tabs 13 thereabove to allow the easy manipulation of the tabs 13.

Formed along the first lateral side of the back cover 14 is a thumb restraint 18. As best shown in FIG. 1, the thumb restraint 18 preferably comprises a thumb restraint area 18*a* and thumb mass restraint area 18*b*. The thumb restraint 18 preferably prevents the user's thumb and fleshy part of the palm between the thumb and the wrist (hereinafter "thumb mass") from protruding into the area above and between the front cover 11 and pages 12 so as to prevent the thumb and thumb mass from interfering with either the turning of the front cover 11 and the pages 12 or the reading of the information printed thereon. Preferably, the thumb restraint area 18*a* is formed along the first lateral side of the back cover 14 and spans from the upper end of the first lateral side to approximately the midpoint of the first lateral side of the back cover 14. The thumb mass restraint area 18*b* is formed along the first lateral side of the back cover 14 and preferably spans from approximately the midpoint of the first lateral side to a point less than approximately one inch from the lower end of the first lateral side of the back cover 14. The thumb restraint area 18*a* extends beyond the width of the front cover 11 and pages 12 a distance adequate for supporting the user's thumb, preferably approximately 0.125 inches. The thumb mass restraint area 18*b* extends beyond the width of the front cover 11 and pages 12 a distance that is greater than that of the thumb restraint area 18*a* and is adequate for supporting the user's thumb mass, preferably approximately 0.25 inches.

In use, the user places his or her thumb against the thumb restraint area 18*a*, his or her thumb mass against the thumb mass restraint area 18*b*, and his or her fingers inside the troughs 17*b*, each of which is aligned with a tab 13 corresponding to an informational section in which the user is interested. While each book 10 typically has more than four tabs 13 and troughs 17*b*, the user may easily move his or her fingers among the troughs 17*b* to gain access to all of the tabs 13. The user then selects a section of the book 10 he or she wishes to consult, secures the tab 13 associated with the selected section with his or her finger, and provides an upward rotational force on the book 10 to cause the pages above the page having the secured tab to rotate behind the back cover 14, bringing the selected section to the forward end of the book 10. In order to more easily allow the front cover 11 and pages 12 to be rotated, each are preferably made of a heavy gauge paper, preferably plastic coated for increased durability. The tabs 13 are preferably made of the same material as the pages 12 along which they are formed for ease of manufacture. In addition to allowing the front cover 11 and pages 12 to be more easily rotated, the heavier material also provides the book 10 greater protection.

Figure 3:
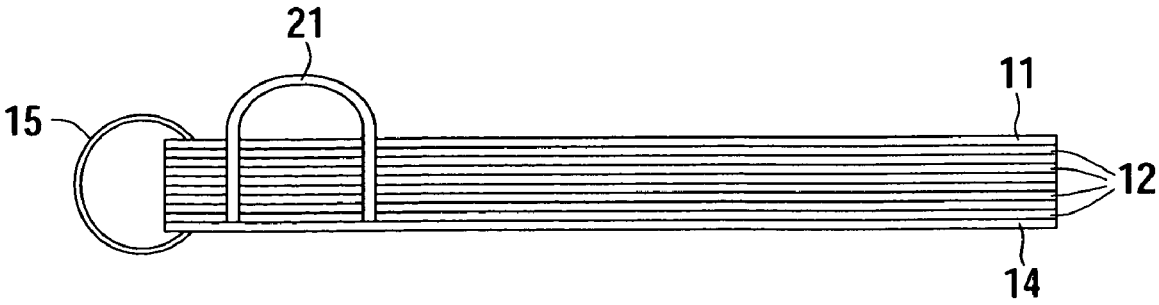
FIG. 3 is a side view of the preferred embodiment of the present invention.

To allow the front 11 and back 14 covers and pages 12 to turn freely about the rings 15, the rings 15 preferably do not entirely fill each hole 19. However, this remaining space inside each hole 19 allows any of the pages 12 some movement relative to the rings 15 and thus to become askew from the remaining pages 12. A user attempting to secure a tab will preferably press downwardly thereon. However, since, due to the design of the apparatus 10, the securing finger would point inwardly towards the center of the book 10, most likely at least some lateral force would be exerted on the tab and page along which the tab is formed, thus potentially causing the page to become askew. As best shown in FIG. 3, to diminish such chance of a skewed page, the apparatus 10 preferably has a guard 21 attached to the first lateral side of the back cover 14 to prevent the lateral movement of the front cover 11 and any of the pages 12. Preferably, the guard 21 is attached to the thumb restraint 18. The guard 21 is preferably U-shaped with the plane of the guard 21 being substantially perpendicular to the plane of the pages 12. The height of the guard 21 is preferably adequate for preventing the lateral movement of the topmost page 12 having a tab 13 attached thereto. The back cover 14, finger locks 17, thumb restraint 18, and guard 21 are preferably all made of a single material for ease of manufacture, preferably plastic or some other material suitable for resisting wear from forces exerted by the user's thumb, thumb mass, and fingers and for providing substantial resistance against pages attempting to become askew.

The rear surface of the back cover 14 preferably has an elastic band (not shown) or other securing means attached thereto. The elastic band is preferably of sufficient length and elasticity so that it may be used to secure the book 10 while not in use. Furthermore, the elastic band is capable of securing a writing utensil (not shown) such as a pen or mechanical pencil, which may be used to take notes within the book 10 or to copy notes from the book 10 onto another sheet of paper.

While the finger slots 17 and tabs 13 are required to be on the same lateral side of the book 10, those features may appear on either the left or right side to an observer facing the front of the book 10. Where the finger slots 17 and tabs 13 appear on the right side of the book 10, the book 10 is designed to be held in the left hand. Conversely, where the finger slots 17 and tabs 13 appear on the left side of the book 10, the book 10 is designed to be held in the right hand. If, for example, a user wishes to take notes about the contents of the book 10 while flipping through the different pages 12, the hand with which the user comfortably writes would limit the user to a book 10 with finger slots 17 and tabs 13 on one particular side. Since most people are right-handed, most books 10 would have finger slots 17 and tabs 13 on the right side of the book 10. However, it is envisioned that books 10 having finger slots 17 and tabs 13 on the left side would also be produced.

It is to be understood that the forms of the invention shown and described are preferred embodiments thereof and that various changes and modifications may be made therein without departing from the spirit of the invention or scope as defined in the following claims. For example, it is foreseen that the book can include blank pages for simple note-taking, or can be directed to a particular professional endeavor, such as engineering, wherein the book can be designed for field use.

The invention claimed is:

1. A book designed for one handed manipulation, comprising:

a. a front cover having an upper end, a lower end, and first and second lateral sides;

b. a back cover having an upper end, a lower end, and first and second lateral sides, wherein said first lateral side of said back cover comprises a thumb restraint and said second lateral side of said back cover comprises a plurality of finger slots;

c. a plurality of pages between said front and back covers, wherein each of said pages has an upper end, a lower end, and first and second lateral sides, and wherein said second lateral side of each of said plurality of pages includes a tab that extends beyond said second lateral side of said front cover; and d. means for connecting said upper end of said front cover, said upper end of each of said plurality of pages, and said upper end of said back cover;

e. wherein said thumb restraint extends beyond said first lateral side of each of said front cover and said plurality of pages a distance adequate to support a user's thumb and thumb mass such that they do not engage said plurality of pages or said front cover; and f. wherein said finger slots and said tabs are positioned such that each of said tabs may be secured by a finger in at least one of said finger slots and a one-to-one ratio exists between said finger slots and said tabs such that an outside edge of each of said tabs is tangent to a nadir of exactly one finger slot.

2. A book according to claim 1 wherein said thumb restraint comprises a thumb restraint area and a thumb mass restraint area.

3. A book according to claim 1 wherein said front cover, pages, and back cover each has a plurality of holes along said upper ends thereof.

4. A book according to claim 3 wherein said connecting means comprises a plurality of rings and wherein each of said holes has a ring passing therethrough such that each of said rings engages said front cover, said plurality of pages, and said back cover.

5. A book according to claim 1 wherein said pages have travel information printed thereon.

6. A book according to claim 5 wherein said pages are divided into sections according to different types of said information printed thereon and wherein each of said tabs indicates the first page of a section.

7. A book according to claim 1 further comprising a guard attached to said first lateral side of said back cover wherein said guard is capable of impeding lateral movement of at least some of said pages.

8. A book according to claim 7 wherein a plane of said guard is substantially perpendicular to a plane of said back cover.

* * * * *